US006724303B2

(12) United States Patent
McGunn et al.

(10) Patent No.: US 6,724,303 B2
(45) Date of Patent: Apr. 20, 2004

(54) METHOD AND APPARATUS FOR MONITORING A SAFE

(75) Inventors: Edward J. McGunn, Chicago, IL (US); James Ivey, III, Posen, IL (US); Gregory Grzegorz Dylewski, Chicago, IL (US); Eduardo DeCastro Barcellos, Posen, IL (US)

(73) Assignee: Corporate Safe Specialists, Inc., Posen, IL (US)

( * ) Notice: Subject to any disclaimer, the term of this patent is extended or adjusted under 35 U.S.C. 154(b) by 0 days.

(21) Appl. No.: 09/982,384

(22) Filed: Oct. 18, 2001

(65) Prior Publication Data

US 2003/0076228 A1 Apr. 24, 2003

(51) Int. Cl.[7] ..... G08B 19/00

(52) U.S. Cl. ..... 340/521; 340/522; 340/542; 340/545.1; 348/143; 348/159

(58) Field of Search ..... 340/541, 540, 340/545.1, 542, 5.28, 5.3, 5.31, 521, 522; 707/104.1, 500.1; 345/420; 386/112, 117; 348/143, 159; 360/5; 194/206; 109/24.1, 53; 221/125

(56) References Cited

U.S. PATENT DOCUMENTS

| | | | | | |
|---|---|---|---|---|---|
| 3,878,511 | A | * | 4/1975 | Wagner | 340/5.28 |
| 4,001,881 | A | * | 1/1977 | Folsom | 360/5 |
| 5,519,669 | A | * | 5/1996 | Ross et al. | 367/93 |
| 5,725,081 | A | * | 3/1998 | Meeker | 194/206 |
| 5,735,742 | A | * | 4/1998 | French | 463/25 |
| 5,915,069 | A | * | 6/1999 | Nishijima | 386/112 |
| 6,130,611 | A | * | 10/2000 | Pellaton et al. | 340/542 |
| 6,144,375 | A | * | 11/2000 | Jain et al. | 707/500.1 |

* cited by examiner

*Primary Examiner*—Benjamin C. Lee
(74) *Attorney, Agent, or Firm*—Wood, Phillips, Katz, Clark & Mortimer

(57) ABSTRACT

The present invention generally relates to a method of monitoring a safe comprising the steps of providing (402) an electronic lock for the safe; receiving (404) information from a security device in an area proximate to the safe; and making (406) security information from the security device during a transaction with the electronic lock. According to another aspect of the invention, an apparatus for monitoring a safe comprises an electronic lock (144) incorporated in a safe; a control unit (142) coupled to the electronic lock; and a security system (148) coupled to the control unit.

26 Claims, 6 Drawing Sheets

AUDIT TRAIL CHART

AUDIT TRAIL FRAME
902
904
ALL ACTIVITIES TOOL BAR
BV DEPOSIT TOOL BAR
910
906
USER ACTIVITIES TOOL BAR
MANUAL DEPOSIT TOOL BAR
912
908
DOOR ACTIVITIES TOOL BAR
TOTAL DEPOSIT TOOL BAR
914
920
TIME FRAME FRAME
CHANGE REQUEST TOOL BAR
916
922
SHIFT 1 OPTION BUTTON
926
FULL DAY OPTION BUTTON
924
SHIFT 2 OPTION BUTTON
934
RETURN COMMAND BUTTON
930
DISPLAY COMMAND BUTTON
932
PRINT COMMAND BUTTON

METHOD AND APPARATUS FOR MONITORING A SAFE

FIELD OF THE INVENTION

This invention generally relates to safes, and more particularly to a method and apparatus for monitoring a safe having an electronic lock.

BACKGROUND OF THE INVENTION

Throughout history, people have developed locks and/or safes to protect currency or other valuable items. As electronics continued to advance, electronic locks were developed. Such electronic locks made the use of locks and safes more convenient. However, as the method of doing business of various stores and businesses has changed, the needs for locks, including some electronic locks, has changed. In particular, while locks or safes may prevent criminals from stealing currency, such locks do not prevent accounting errors or the theft of currency by individuals who have access to the safes. That is, once a conventional safe is open, transactions related to the contents of the safe are not recorded.

As more stores have extended hours, including 24 hour stores, more employees have access to a store's currency. Similarly, as more stores continue to grow and add chains or franchises, these stores have a greater amount of currency and a larger number of locations to monitor. While security systems provide information of occurrences in a facility, such as a store, such information provides little guidance as to specific occurrences of an electronic lock of a safe at relevant times. That is, the security recordings would have to be reviewed in isolation to determine what a security system recorded during a particular transaction at a safe.

Accordingly, there is a need for an improved method and apparatus for monitoring a safe having an electronic lock.

SUMMARY OF THE INVENTION

The present invention generally relates to a method of monitoring a safe comprising the steps of providing an electronic lock for the safe, recording information from a security device in an area proximate to the safe, and marking security information from the security device during a transaction with the electronic lock.

According to another aspect of the invention, an apparatus for monitoring a safe comprises an electronic lock incorporated in a safe, a control unit coupled to the electronic lock, and a security system coupled to the control unit.

According to a further aspect of the invention, a system for monitoring a safe comprises an electronic lock coupled to a safe, a security device coupled to the electronic lock, a local computer coupled to the electronic lock; and a remote computer coupled to the local computer by way of a communication network.

It is an object of the invention to provide a method and apparatus for monitoring a safe having an electronic lock by an external control unit.

It is a further object of the invention to monitor a safe having an electronic lock from a remote location.

It is a further object of the invention to couple a security system to a control unit associated with an electronic lock for monitoring the activity of a safe.

It is a further object of the invention to create an audit trail related to transactions of a safe recorded by an electronic lock.

It is a further object of the invention to coordinate information from a security device and an electronic lock in response to a duress condition recorded by the electronic lock of a safe.

Other objects and advantages will become apparent from the following specification taken in connection with the accompanying drawings.

DESCRIPTION OF THE PREFERRED EMBODIMENTS

Figure 1:
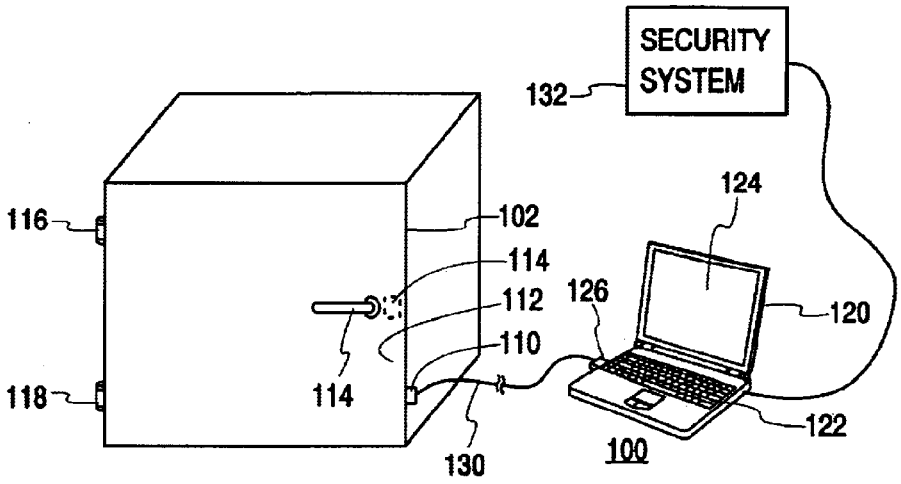
FIG. 1 is a block diagram of a system for monitoring a safe having an electronic lock according to the present invention.

Turning now to FIG. 1, a perspective view shows a safe having an electronic lock which is coupled to a control unit. In particular, an electronic locking system 100 comprises a safe 102 having an electronic lock 104. The electronic lock 104 further includes an input/output port 110. Finally, the safe 102 includes a door 112, a handle 114, and hinges 116 and 118. Although a single door is shown, it will be understood that the safe could include a plurality of doors, as is well known in the art.

The electronic locking system 100 further includes a control unit 120 preferably having a keypad 122 and a display 124. The control unit 120 further includes an input/output port 126 for communicating with the electronic lock 104 by way of a communication link 130. The control unit 120 could be any conventional computer or other communication device. The control unit 120 could be remotely located and communicate with the electronic lock 104 by any known protocol, such as RS-232, or some proprietary protocol, over a wireline or wireless interface or network. Finally, a security system 132 is coupled to control unit 120.

Although the elements of the electronic lock apparatus are shown in the orientation of FIG. 1, the elements of the electronic locking system 100 are coupled such that the control unit 120 receives information from both the electronic lock 104 and the security system 132. Similarly, while a single control unit 120 and a single electronic lock 104 are shown, a plurality of control units 120 could communicate with more than one of electronic lock 104 or more than one safe 102. Further, as will become apparent in reference to the remaining figures, the communication link 130 could link the control unit 120 to the electronic lock 104 locally or over a remote network. If the control unit 120 is in close range to electronic lock 104, any short range wireless transmission protocol could be used. Similarly, a remote communication link could be achieved by a conventional landline connection, or wirelessly.

Figure 2:
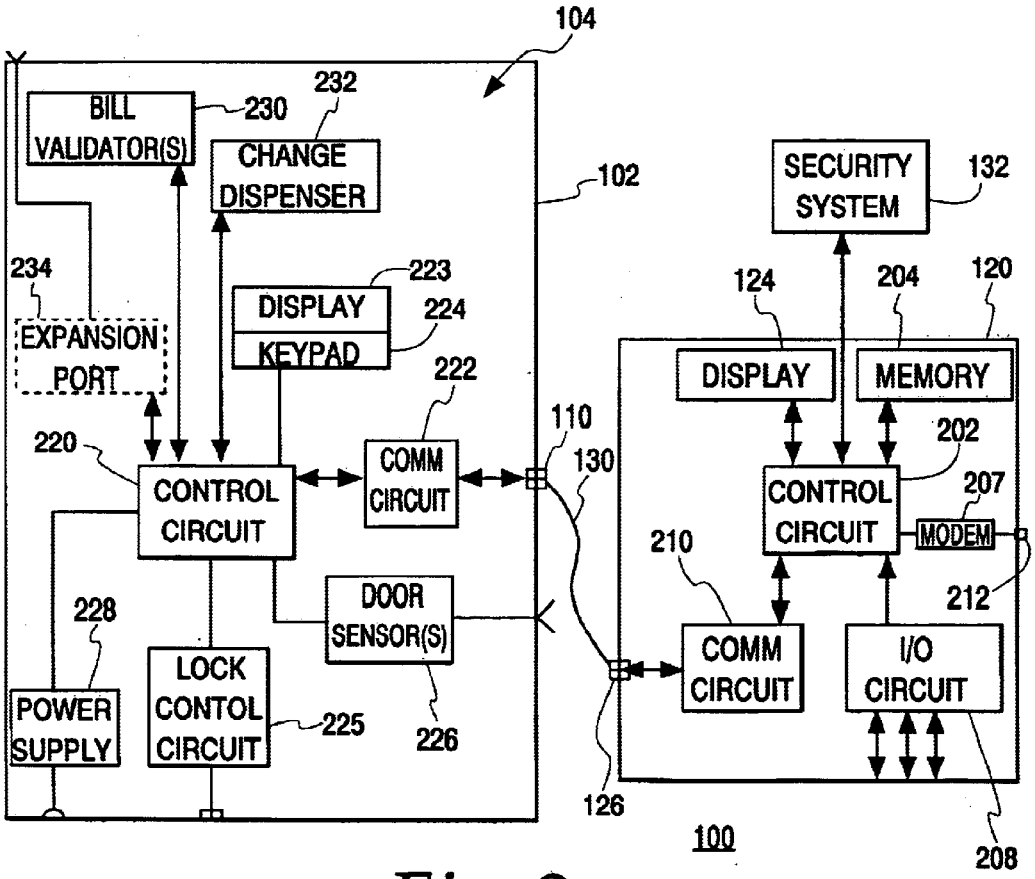
FIG. 2 is a block diagram of an electronic lock apparatus of FIG. 1.

Turning now to FIG. 2, a block diagram shows the electronic locking system 100 in greater detail. In particular, the control circuit unit 120 includes a control circuit 202, such as a microprocessor or other integrated circuit, coupled to a memory 204 for storing information received from the electronic lock 104 or security system 132. The control unit 120 further comprises a modem 207 which enables communication from an external device, such as a second control unit (not shown) at a remote location. Also, an input/output circuit 208 is adapted to couple any type of peripheral device, such as a keyboard for receiving information or a printer for printing information, to the control circuit 202. Finally, a communication circuit 210 enables communication by way of an input/output port 126 which is coupled by way of the communication link 130 to the input/output port 110 coupled to the electronic lock 104. The communication link 130 enables the transfer of information between the control unit 120 and an electronic lock 104, and could be a wired or wireless link. While the control unit 120 could be external to the safe, it could be located within the safe according to the present invention. Alternatively, some or all elements of the control unit 120 could be incorporated within the electronic lock 104.

The electronic lock 104 preferably comprises a control circuit 220 which is coupled to a communication circuit 222 for receiving information by way of the input/output port 216. The communication circuit 222 could be any circuit for enabling communication between the control unit 120 and the electronic lock 104 according to any known protocol, such as RS-232, or a proprietary protocol. The communication circuit 222 could be a conventional modem, or a custom ASIC for enabling communication between the devices.

The electronic lock 104 could optionally include a display 223 for displaying information and a keypad 224 for inputting information at the safe. The electronic lock 104 further includes a lock control circuit 225 for controlling one or more locks of the safe. One or more door sensors 226 are also preferably incorporated in the electronic lock 104 and coupled to the control circuit 220 to detect the state of a door of the safe. A power supply 228, such as an A/C power supply circuit, provides power to the control circuit and other elements of the electronic lock. A bill validator 230 and a change dispenser 232 are also coupled to the control circuit to enable a user of the safe to deposit currency and/or receive change without opening the safe. Finally, the electronic lock 104 preferably includes an expansion port 234 to enable the use of other optional peripheral devices such as a password keyboard, infrared key or other hardware, if desired.

Figure 3:
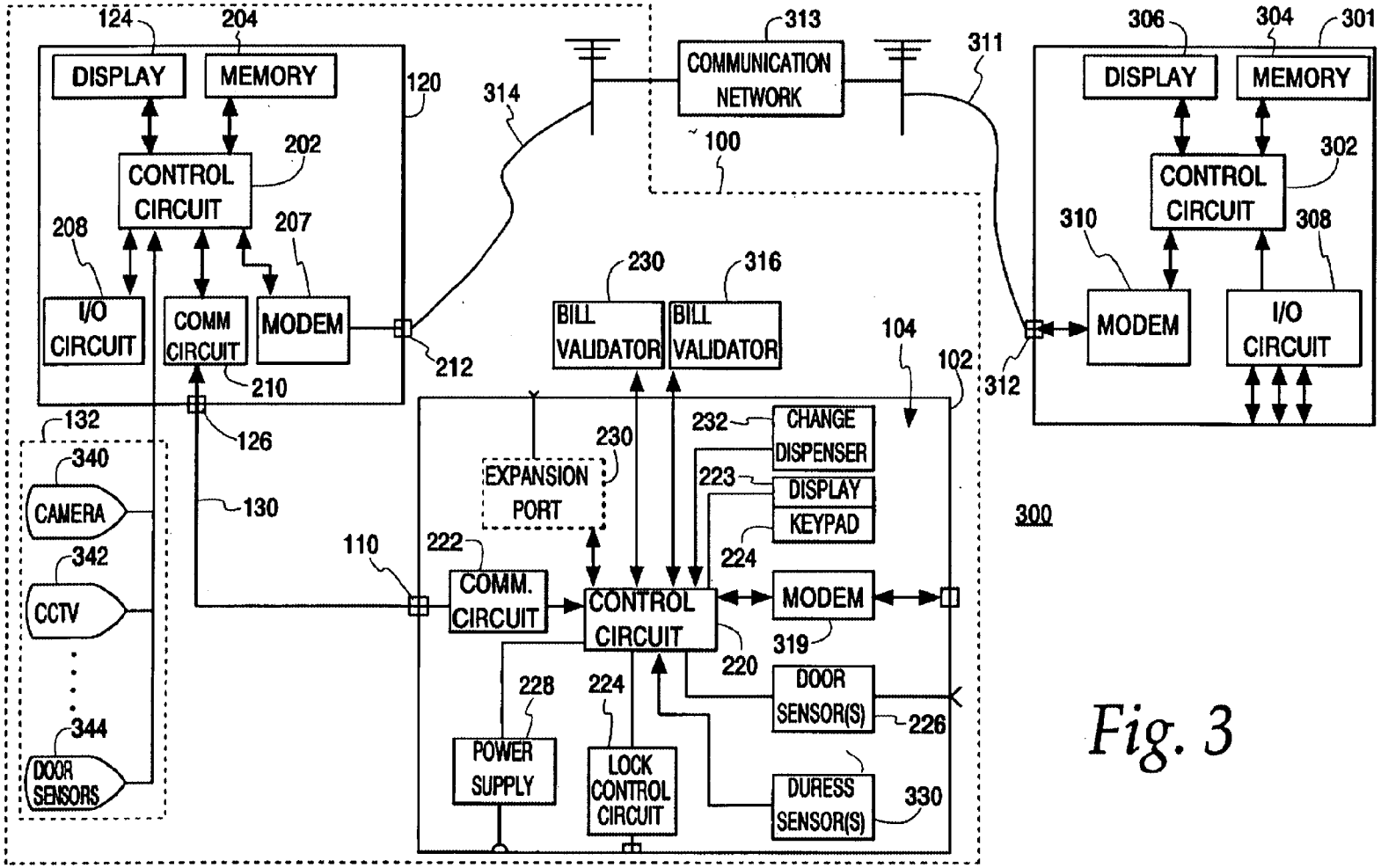
FIG. 3 is a block diagram of an electronic locking system enabling remote access according to an alternate embodiment of the present invention.

Turning now to FIG. 3, a block diagram shows an electronic locking system 300 enabling remote access to a lock of a safe according to the present invention. In particular, a control unit 301 remote from the lock includes a control circuit 302 coupled to a memory 304 preferably for receiving and/or storing data or information collected by the electronic locking system 300. The control unit 301 further includes a display 306 and an input/output circuit 308 for receiving information from or providing information to a peripheral device, such as a keyboard or printer, as is well known in the art. The control unit 301 further includes a modem 310 coupled to a communication link 311 by way of an input/output port 312. The modem 310 enables communication between the control unit 301 and the electronic locking system 100 over a communication network 313. The communication network 313 could be any type of landline or wireless communication network to enable communication with electronic locking apparatus 100 by way of communication link 314.

In addition to the common features already described in reference to FIG. 2, the electronic lock system 100 of FIG. 3 includes an additional bill validator 316 to improve the ability to read currency. The electronic lock 104 could further include a modem 319 to enable a direct communication with the electronic lock 104, if desired. The safe 102 could further include a duress sensor 330, such as a vibration sensor or motion sensor to detect unauthorized activity at the safe. Finally, the security system 132 preferably comprises a camera 340, a closed circuit TV 342, or a door sensor 344. As will be described in reference to later figures, a duress condition could also be recorded by a user entering a predetermined code on a keypad, such as modifying the user's ID by replacing the last digit with a predetermined number, for example. However, it will be understood that other elements of security systems which are well known in the art could be employed according to the present invention.

Figure 4:
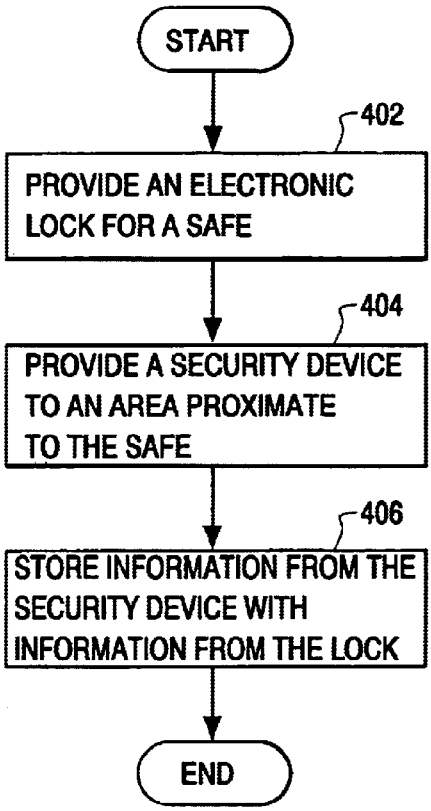
FIG. 4 is a flow chart showing a method for monitoring a safe coupled to a security device according to the present invention.

Turning now to FIG. 4, a flow chart shows a method for monitoring a safe coupled to a security device according to the present invention. An electronic lock is provided for a safe in a step 402. The electronic lock could be, for example, the electronic lock 104. A security device, such as the security device 108 in an area proximate to the safe is provided as step 404. Information from the security device and information from an electronic lock is then stored at a step 406. As will be described in more detail to the remaining figures, the information is preferably stored in such a way to enable the easy identification of security information recorded during transactions at the electronic lock.

Figure 5:
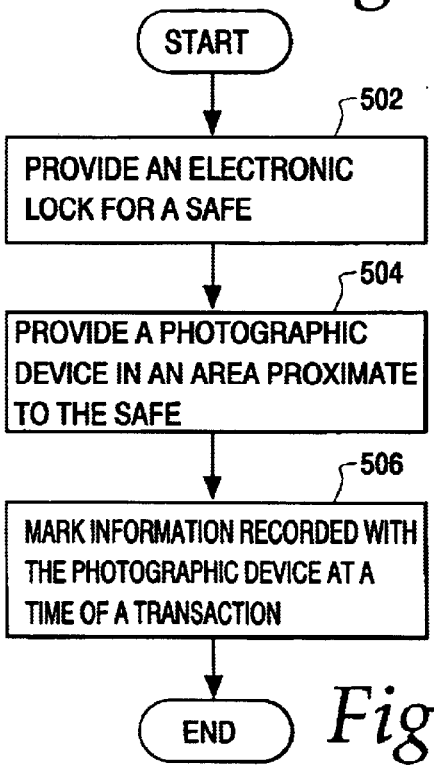
FIG. 5 is a flow chart showing a method for monitoring a safe coupled to a photographic device according to an alternate embodiment of the present invention.

Turning now to FIG. 5, a flow chart shows a method for monitoring a safe coupled to a photographic device of a security system according to an alternate embodiment of the present invention. In particular, a safe is provided for an electronic lock at a step 502. A photographic device is coupled to an electronic lock of the safe in an area proximate to the device at a step 504. Finally, information recorded by the photographic device at the time of the transaction is then "marked" at a step 506 to enable easy access of security photos or video associated with a particular transaction. The photographic device could be any type of still or video camera, and could be coupled to the electronic lock of the safe by any means, such as a cable, or a wireless communication means.

Figure 6:
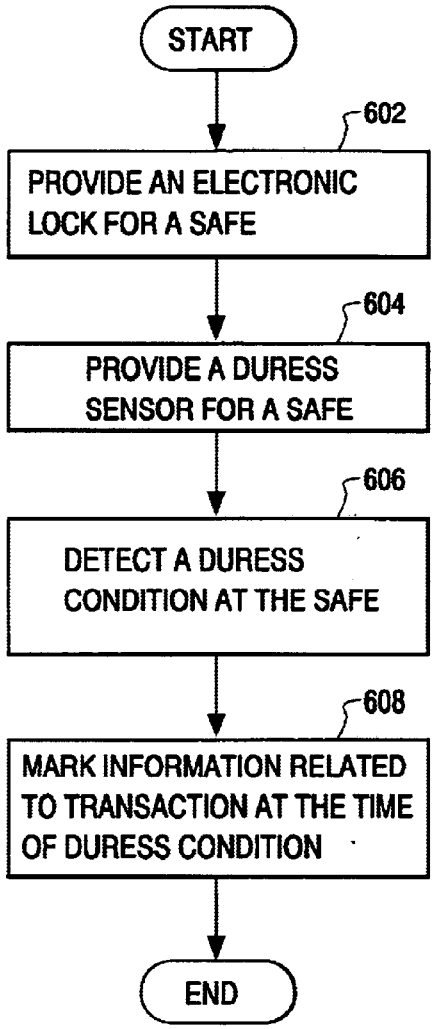
FIG. 6 is a flow chart showing a method for monitoring a safe having a duress sensor according to a further alternate embodiment of the invention.

Turning now to FIG. 6, a flow chart shows a method for monitoring a safe having a duress sensor according to a further alternate embodiment of the present invention. In particular, an electronic lock is provided for a safe at a step 602. A duress sensor is coupled to the safe at a step 604. The duress sensor could be a conventional sensor, such as a vibration sensor or motion sensor, or it could be a software feature of an electronic lock enabling a user to provide an alert of the duress condition. When a duress condition is detected at the safe at a step 606, information related to transactions of the electronic lock during a duress condition is marked at a step 608. Such information could include both information recorded by the electronic lock as well as information from a security system coupled to the electronic lock on a control unit.

Figure 7:
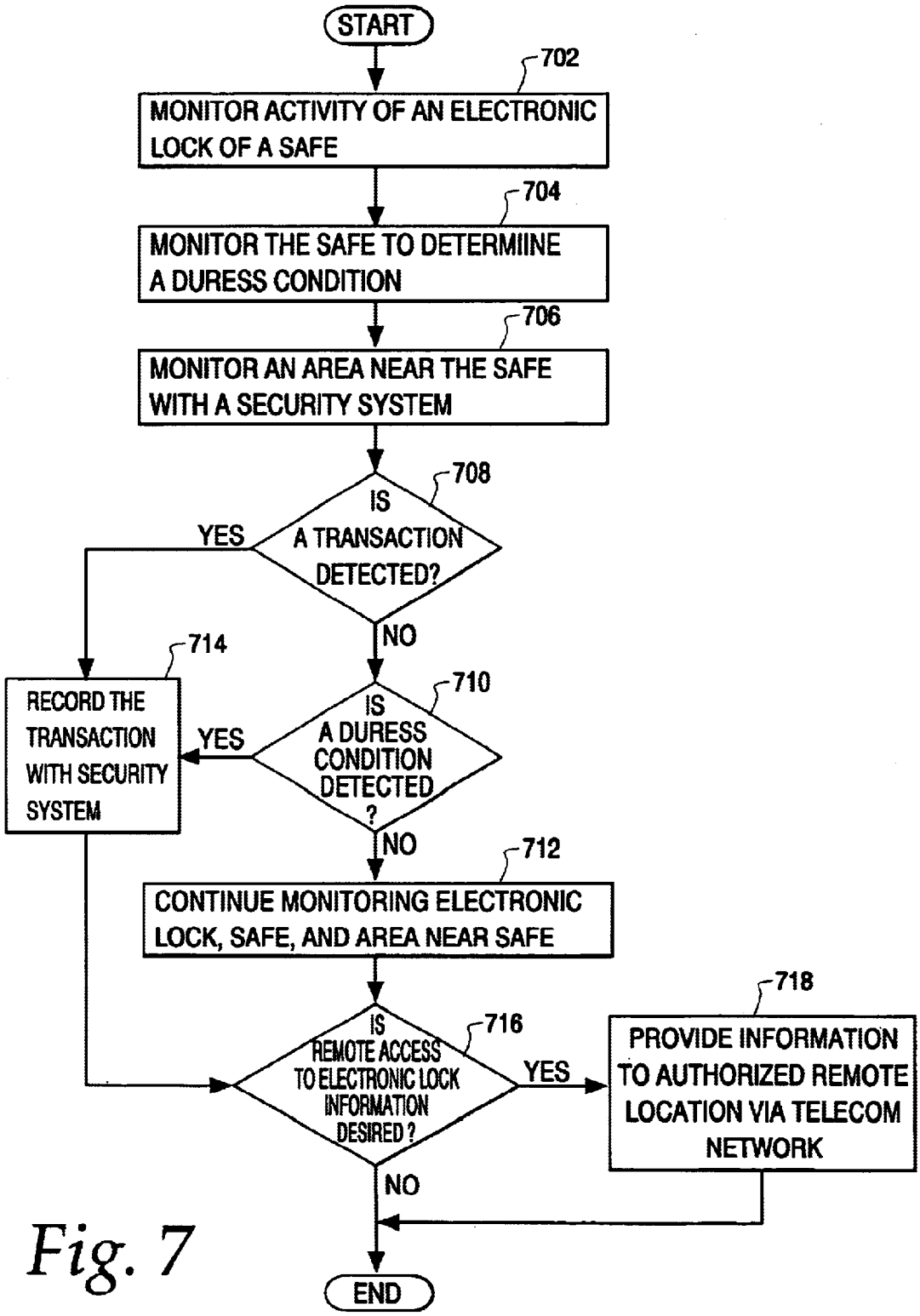
FIG. 7 is a flow chart showing a method for monitoring a safe having an electronic lock from a remote location according to the present invention.

Turning now to FIG. 7, a flow chart shows a method for monitoring a safe having an electronic lock from a remote location according to the present invention. In particular, activities of the electronic lock of a safe are monitored at a step 702. The safe is also monitored to determine a duress condition at a step 704. The area near the safe is monitored with a security system at a step 706. The security system preferably records any events or occurrences in the area near the safe. Such occurrences could include any activities ranging from a buyer entering a store to a store employee approaching the safe. It is then determined whether a transaction is conducted with the electronic lock of the safe at a step 708. If no transaction is detected, it is determined if a duress condition is detected at the safe at a step 710. If neither condition is detected, the electronic lock, safe, and area near the safe continues to be monitored at a step 712.

However, if a transaction is conducted or a duress condition is detected, the information recorded by the security system during the transaction is marked for easy identification at a later time at a step 714. For example, while the security system may continuously monitor or record the area around the safe, the security system can isolate occurrences during a transaction and "mark" portions of a recording associated with certain occurrences during the transaction. Such transactions could include depositing money into the safe or receiving change, or any of the functions described in reference to FIG. 8. It is then determined whether a remote access to the electronic lock information is desired at a step 716. If the information is desired, the information is provided to an authorized user at a remote location by way of a communication network at a step 718.

Figure 8:
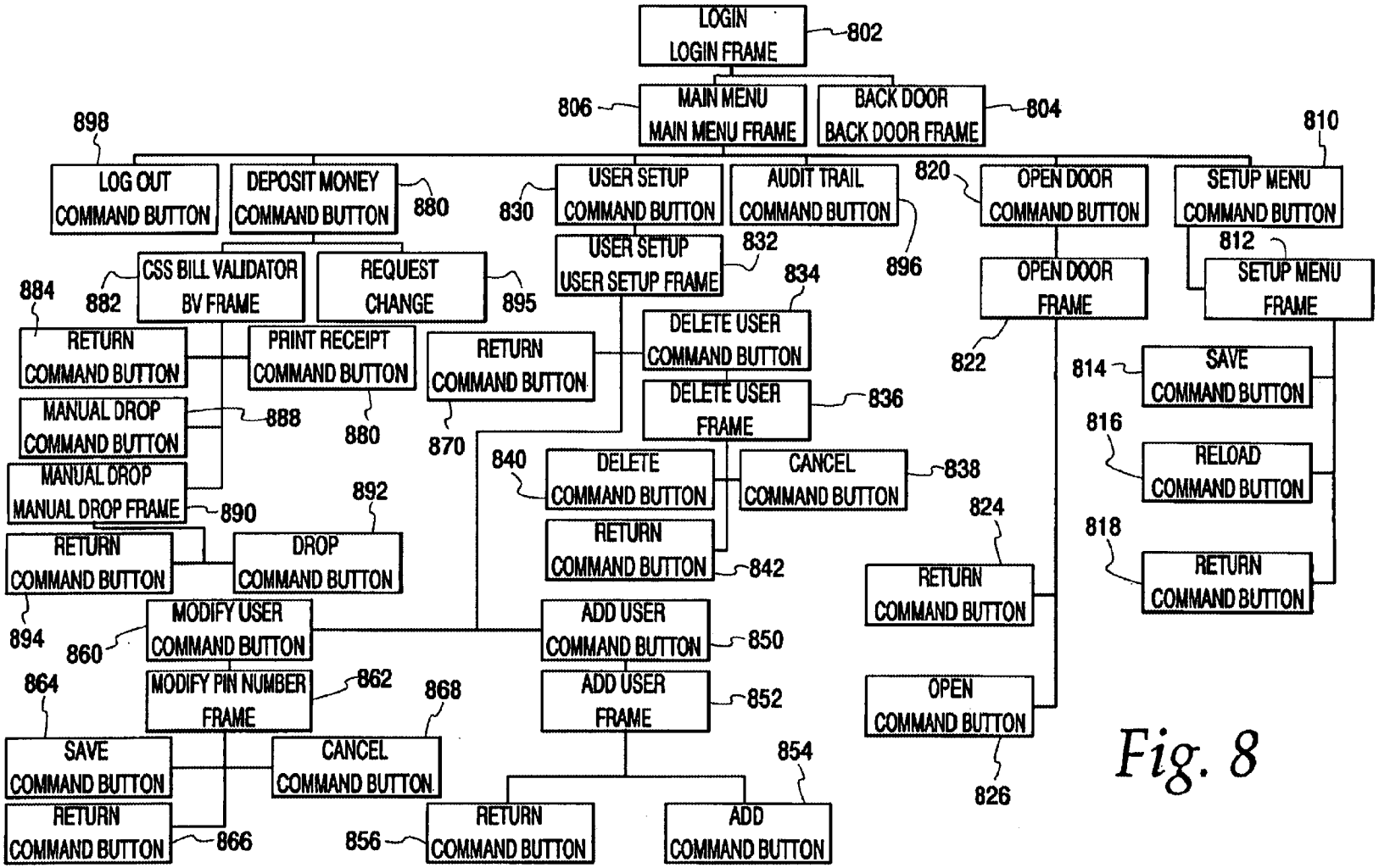
FIG. 8 is a tree diagram showing the functions of software for monitoring a safe having an electronic lock according to the present invention.

Turning now to FIG. 8, a tree diagram shows the functions of software adapted to perform the methods of the present invention. Such functions could be implemented in software running on any operating system, such as a Windows based system. In particular, a LOGIN Frame 802 is accessible by selecting the program incorporating the methods of the present invention. For example, the program could be selected on control unit 120 as shown in FIGS. 1 and 2. The LOGIN Frame generally includes areas for receiving login information, such as a user ID and a personal information number (PIN). A user could optionally select a BACK DOOR Frame 804, which would enable a user to more quickly login. For example, by selecting a secret location on the frame or entering an override response key, the user could gain access to the MAIN MENU Frame 806.

When the MAIN MENU Frame is reached, a number of command buttons are shown. For example, a SET UP MENU Button 810 enables a user to select a SET UP MENU Frame 812. The SET UP MENU Frame 812 preferably includes an option to select a variety of functions performed by the software. For example, a user could specify the communications port, the number of doors controlled by the electronic lock, the types of bill accepted, the use of sound, the number of work shifts, e-mail addresses for notification, or preferences for marking and storing information recorded by the security system. Within the SET UP MENU Frame 812 are a SAVE Command Button 814 to allow a user to save the selected set of features, a RELOAD Command Button 816 to allow a user to return to previous settings, and a RETURN Command Button 818 to return to the main menu, for example, after saving new set up options.

An OPEN DOOR Command Button 820 is also present on the MAIN MENU Frame 806. The OPEN DOOR Command Button 820, when selected, accesses an OPEN DOOR Frame 822. The OPEN DOOR Frame 822 includes a RETURN Command Button 824 and an OPEN Command Button 826. The OPEN Command Button 826 generally enables a user to open the safe door by way of the electronic lock. Such a selection of an OPEN Command Button is preferably saved in an audit trail database, as will be described in more detail in reference to FIG. 9.

The MAIN MENU Frame also includes a USER SETUP Command Button 830, which when selected, accesses a USER SETUP Frame 832. When in the USER SETUP Frame 832, a user can select a DELETE USER Command Button 834. If selected, the DELETE USER Command Button 834 leads to a DELETE USER Frame 836 having a CANCEL Command Button 838, a DELETE Command Button 840, and a RETURN Command Button 842. Accordingly, a particular user, when highlighted on the DELETE USER Frame 836, can be deleted by selecting the DELETE Command Button 840.

Similarly, a user can be added by selecting the ADD USER Command Button 850 on the USER SET UP Frame 832. When the ADD USER Command Button 850 is selected, an ADD USER Frame 852 is accessed. The user information for a new user is then added to the ADD USER Frame, and an ADD Command Button 854 can then be selected. A RETURN Command Button 856 can then be selected to return to the USER SET UP Frame.

Authorized users can also select a MODIFY USER Command Button 860 to access a MODIFY PIN NUMBER Frame 862. The MODIFY PIN NUMBER Frame allows an unauthorized user to change a PIN number for a user, and save the change by selecting a SAVE Command Button 864. The user can cancel the change by selecting the CANCEL Command Button 866 or return to the USER SETUP Frame 832 by selecting a RETURN Command Button 868. Finally, a RETURN Command Button 870 is also included in the USER SETUP Frame 832 to allow the user to return to the MAIN MENU Frame 806.

A DEPOSIT MONEY Command Button 880 is also displayed on the MAIN USER Frame 806. When selected, a Bill Validator Frame 882 is then displayed activating the bill validator and enabling a user to deposit money into the bill validator. The Bill Validator Frame 882 includes a RETURN Command Button 884 and a PRINT RECEIPT Command Button 886. A MANUAL DROP Command Button 888 is also included to allow a user to manually deposit money within the safe, for example if the Bill Validator will not accept a particular bill. The MANUAL DROP Frame 890, displayed when the MANUAL DROP Command Button 888 is selected, allows a user access a drawer to perform manual drop of currency and enter the amount of currency deposited. The MANUAL DROP Frame 890 also includes DROP Command Button 1092 and a RETURN Command Button 894. A REQUEST CHANGE Button 895 can be selected to enable a user to enter the desired coins to be returned and insert one or more bills into the bill validator to receive change for the bills without opening the safe.

Finally, an AUDIT TRAIL Command Button 896 is included in the MAIN MENU Frame 806 to allow a user to view an audit trail of transactions involved with the safe. The functions of the audit trail feature of the invention will be shown in more detail in reference to FIG. 9. Preferably, a LOG OUT Command Button 898 is also provided on the MAIN MENU 806 to allow a user to log out.

Figure 9:
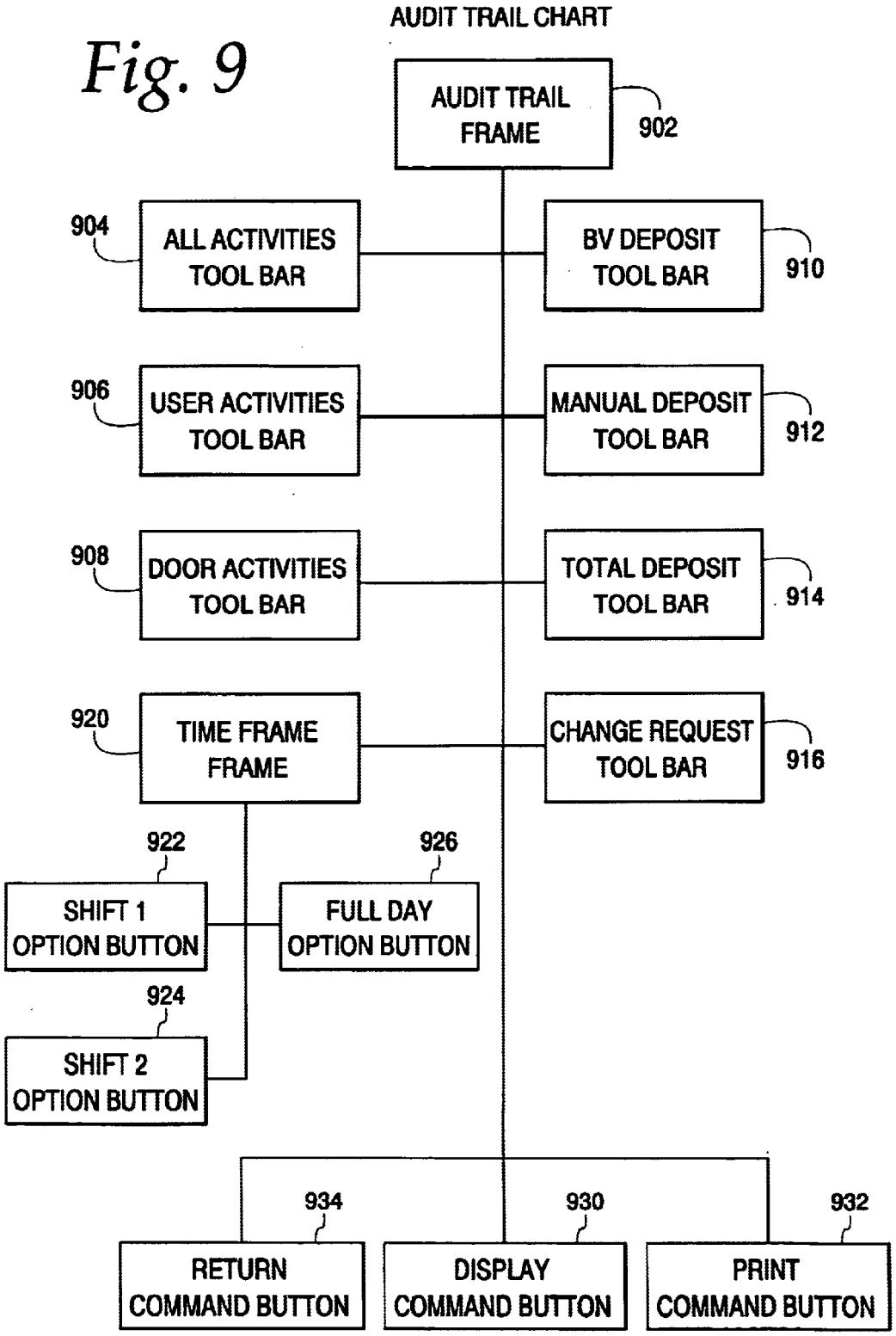
FIG. 9 is a tree diagram showing an audit trail feature for monitoring a safe having an electronic lock according to the present invention.

Turning to FIG. 9, a tree diagram shows functions of the audit trail feature of the present invention. In particular, when the AUDIT TRAIL Command Button 896 of FIG. 8 is selected, an AUDIT TRAIL Frame 902 is displayed. A user can select one of a variety of tool bars to present predetermined information available through the audit trail. In particular, a user can select an ALL ACTIVITIES Tool Bar 904 to view an audit trail of all the activities of the safe. The user could also select a USER ACTIVITIES Tool Bar 906 to select a particular user and view activities of a particular user with the safe. A user could also select a DOOR ACTIVITIES Tool Bar 908. A user could also select a BILL VALIDATOR DEPOSIT Tool Bar 910 to view the deposits made by way of the BILL VALIDATOR. A user could also select a MANUAL DEPOSIT Tool Bar 912 to view an AUDIT TRAIL of manual deposits. Finally, a user could select a TOTAL DEPOSIT Tool Bar 914 to view all deposits recorded in the audit trail database. Finally, a CHANGE REQUEST Tool Bar 916 enables a user to view an audit trail of all requests for change. Preferably, the audit trail includes security information associated with each recorded transaction. For example, one or more photographs could be shown on or accessed from a page having information related to a particular transaction. Similarly, video clippings associated with the transaction could also be accessed. Alternatively, a separate toolbar could include the security information which could be sorted by transaction, for example.

The AUDIT TRAIL Frame 902 also includes a TIME FRAME Frame 920 which allows a user to select a time during which audit trail records were recorded should be displayed. In particular, a user can select a SHIFT 1 Option Button 922, a SHIFT 2 Option Button 924, or a FULL DAY Option Button 926. Finally, the AUDIT TRAIL Frame includes a DISPLAY Command Button 930 to allow a user to display the selected information from the audit trail database, a PRINT Command Button 932 to allow a user to print the displayed information from the audit trail database, or a RETURN Command Button 934 to return to the AUDIT TRAIL frame 996. The audit trail database could be stored on the control unit 120, or in a memory of the control circuit 314 of the safe 102.

It can therefore be appreciated that a new and novel method and apparatus for monitoring a safe has been described. It will be appreciated by those skilled in the art that, given the teaching herein, numerous alternatives and equivalent will be seen to exist which incorporate the disclosed invention. For example, the present invention could incorporate existing security systems, making such systems more valuable. As a result, the invention is not to be limited by the foregoing exemplary embodiments, but only by the following claims.

We claim:

1. A method of monitoring a safe, said method comprising the steps of:

providing an electronic lock for said safe through which a plurality of different types of transactions can be performed;

monitoring said transactions with said electronic lock over a time period and recording first information related to said transactions that identifies the type of transactions performed through the lock safe;

recording second information with a security device external to said safe;

marking said second information recorded by said security device in response to the detection of at least one specific recorded transaction with said electronic lock within the time period; and correlating and reviewing by transaction the first information and the second marked information.

2. The method of claim 1 further including a step of providing the second information recorded by said security device at the time of said at least one specific transaction to a control unit.

3. The method of claim 2 further comprising a step of detecting a duress condition at said safe.

4. The method of claim 3 further comprising a step of marking said information recorded by said security device at a time coincident with said duress condition.

5. The method of claim 4 further comprising a step of providing information related to said duress condition to said control unit.

6. The method of claim 3 wherein said step of detecting a duress condition comprises detecting a predetermined code entered by a user on the electronic lock.

7. The method of claim 3 wherein said step of detecting a duress condition comprises detecting a duress condition recorded by a sensor associated with said safe.

8. The method of claim 3 further comprising a step of saving information related to said duress condition with said second information recorded by said security device.

9. The method of claim 3 further comprising a step of providing an audit trail of said duress condition and said second information recorded by said security device.

10. The method of claim 1 further comprising a step of detecting a state of a door for said safe.

11. The method of claim 1 further comprising a step of providing said second information recorded by said security device and first information related to said at least one specific transaction to a user at a location remote from the safe.

12. The method of claim 1 wherein said step of recording the second information with a security device comprises recording the second information with a photographic device that produces visual information.

13. The method of claim 12 further comprising a step of time-stamping said visual information.

14. The method of claim 1 further comprising a step of enabling the access of said second information recorded by said security device from a location remote from the safe.

15. The method of monitoring a safe according to claim 1 wherein the step of marking said second information comprises marking said second information recorded with said security device at a time coincident with the detection of the at least one specific recorded transaction.

16. The method of monitoring a safe according to claim 1 wherein one of the different types of transactions is reading currency removed from the safe.

17. The method of monitoring a safe according to claim 1 wherein one of the different types of transactions is reading currency deposited to the safe.

18. The method of monitoring a safe according to claim 1 wherein one of the different types of transactions is sensing the state of a door on the safe.

19. An apparatus for monitoring a safe, said apparatus comprising:

an electronic lock for controlling in a safe and through which a plurality of different types of transactions can be performed;

a control unit external to said safe and coupled to said electronic lock for controlling said electronic lock; and a security means coupled to said control unit for recording security information related to the different types of transactions and selectively marking the recorded security information in response to the occurrence of at least one specific transaction.

20. The apparatus of claim 19 wherein said control unit comprises a computer.

21. The apparatus of claim 20 wherein said computer comprises a remote computer coupled to said electronic lock by way of a communications network.

22. The apparatus of claim 20 wherein said computer comprises a memory.

23. The apparatus of claim 22 wherein said memory comprises a database having an audit trail.

24. The apparatus of claim 19 wherein said electronic lock comprises a bill reader.

25. The apparatus of claim 19 wherein said electronic lock comprises a door sensor.

26. The apparatus of claim 19 wherein said electronic lock comprises a duress sensor.

* * * * *